US008579426B2

(12) United States Patent
Deshiikan et al.

(10) Patent No.: US 8,579,426 B2
(45) Date of Patent: Nov. 12, 2013

(54) METHOD AND SYSTEM FOR DELIVERING SOLID-INK PELLETS

(75) Inventors: Srinivasa R. Deshiikan, Wilsonville, OR (US); Antonio P. Sarmiento, Portland, OR (US); Mark R. James, Lake Oswego, OR (US); John Mulley, Portland, OR (US); Michael Brundige, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 389 days.

(21) Appl. No.: 12/972,296

(22) Filed: Dec. 17, 2010

(65) Prior Publication Data

US 2012/0154493 A1 Jun. 21, 2012

(51) Int. Cl.
*B41J 2/175* (2006.01)

(52) U.S. Cl.
USPC ..... 347/88; 347/85; 347/86; 347/99

(58) Field of Classification Search
USPC ..... 347/84–86, 88, 99
See application file for complete search history.

(56) References Cited

U.S. PATENT DOCUMENTS

| | | | | |
|---|---|---|---|---|
| 6,665,505 | B2 * | 12/2003 | Meetze et al. | 399/106 |
| 8,240,830 | B2 * | 8/2012 | Jones et al. | 347/88 |
| 2003/0117892 | A1 * | 6/2003 | Litwiller | 366/332 |
| 2009/0185016 | A1 * | 7/2009 | Jones | 347/88 |
| 2012/0026258 | A1 * | 2/2012 | Leighton et al. | 347/88 |

* cited by examiner

*Primary Examiner* — Matthew Luu
*Assistant Examiner* — Rut Patel
(74) *Attorney, Agent, or Firm* — Joseph E. Root

(57) ABSTRACT

The present disclosure provides apparatus and method for maintaining the flowability of solid-ink pellets in a system for delivering the pellets to an image-forming device. The apparatus includes a container storing the solid-ink pellets, and an extraction assembly for extracting the solid-ink pellets. The extraction assembly includes a tubular housing, extending from the bottom portion of the container, and an auger member rotatably placed within the tubular housing. The tubular housing receives the solid-ink pellets from the container and the auger member rotates to break up the obstructions to pellet flow.

19 Claims, 3 Drawing Sheets

FIG. 2A
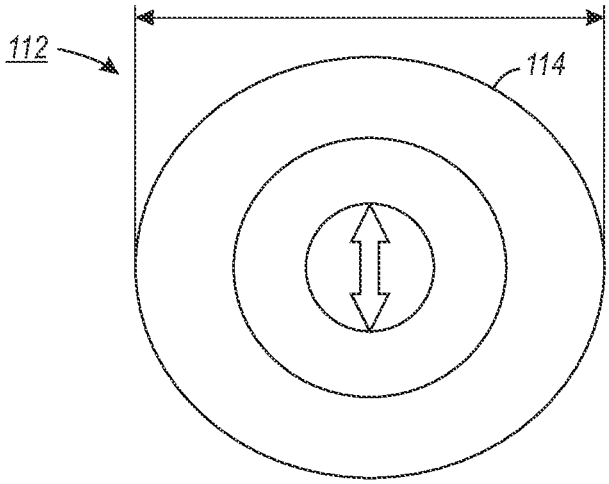
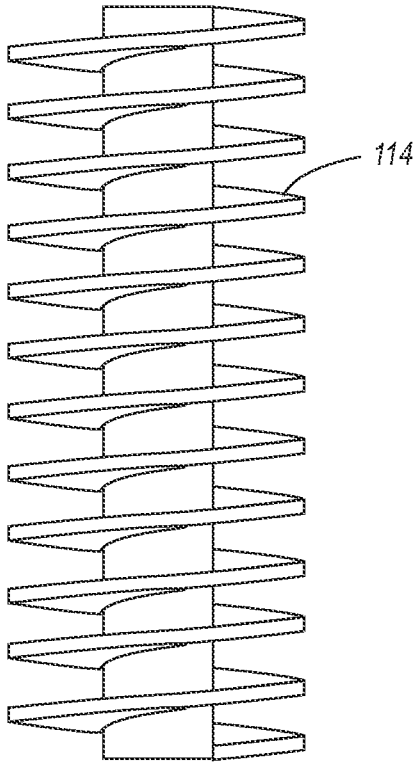
FIG. 2B

METHOD AND SYSTEM FOR DELIVERING SOLID-INK PELLETS

TECHNICAL FIELD

The presently disclosed embodiments relate to extraction of solid-ink pellets for imaging, and more particularly to devices that maintain flowability of solid-ink pellets being extracted from a container.

BACKGROUND

An image-forming apparatus, such as a printer, a fax machine, or a photocopier, includes a system for extracting ink pellets from a container. The system delivers the extracted ink pellets to the image-forming apparatus. Conventionally, solid-ink or phase change ink printers receive ink in solid form, either as pellets or as ink sticks. The solid-ink pellets are stored in a container, and are extracted for print media production, whenever required. A vacuum source pulls the solid-ink pellets from an extraction point in the container, using a vacuum tube.

Generally, when stored in the container over time or when transported, the solid-ink pellets tend to bridge or clump together. Bridging occurs close to the extraction point of the container due to pellets static charge, and this action impedes movement of the solid-ink pellets. Also, solid-ink pellets may fuse together, resulting in clumps, referred to as agglomerates. These bridges and agglomerates obstruct consistent flow of solid-ink particles out of the container.

An existing solution manually agitates the pellet container to dislodge the pellets, resulting in breakage of the bridges and clumps. In general, the containers store large quantity of solid-ink pellets, and manually agitating the container may be cumbersome. Also, the manual agitation depends upon the efficiency of the person agitating the pellets and it is possible that the person may not be able to dislodge all the pellets properly.

It would be highly desirable to have a simple and cost-effective system for maintaining the flowability of solid ink-pellets from a container, breaking up bridges and clumps.

SUMMARY

One embodiment of the present disclosure provides an apparatus for maintaining flowability of solid-ink pellets in a system for delivering the pellets to an image-forming device. The apparatus includes a container storing the solid-ink pellets, and an extraction assembly for extracting the solid-ink pellets. The extraction assembly includes a tubular housing, extending from the bottom portion of the container, and an auger member rotatably placed within the tubular housing. The tubular housing receives the solid-ink pellets from the container and the auger member rotates to break up the obstructions to pellet flow.

Another embodiment discloses a method for maintaining flowability of solid-ink pellets stored in a container, where a tubular housing extends from the container and an auger member, having multiple helical blades, is rotatably placed within the tubular assembly. The method includes rotating the auger member to agitate the solid-ink pellets within the container. The agitated ink pellets are received in a distribution module connected to the bottom end of the tubular housing. Thereafter, a suction force extracts the solid-ink pellets through the distribution module, transferring the pellets to the image-forming device.

BRIEF DESCRIPTION OF THE DRAWINGS

FIGS. 2A and 2B are a top view and a side view, respectively, of an exemplary auger member of FIG. 1.

DETAILED DESCRIPTION

The following detailed description is made with reference to the figures. Preferred embodiments are described to illustrate the disclosure, not to limit its scope, which is defined by the claims. Those of ordinary skill in the art will recognize a number of equivalent variations in the description that follows.

Overview

The present disclosure describes various embodiments of a system and a method for delivering solid-ink pellets from a container to an image-forming device, such as a solid-ink or phase-change printer. The solid-ink pellets are placed in a container, which transfers the solid-ink pellets to the image-forming device. The system provides a mechanism to maintain flowability of the solid-ink pellets by disturbing the solid-ink pellets. The disturbances introduced within the container break up obstructions to the flow of solid-ink pellets to the image-forming device, and a suction force extracts the solid-ink pellets. The solid-ink pellets can then be melted using a heating mechanism in the image-forming device.

Exemplary Embodiment

Figure 1:
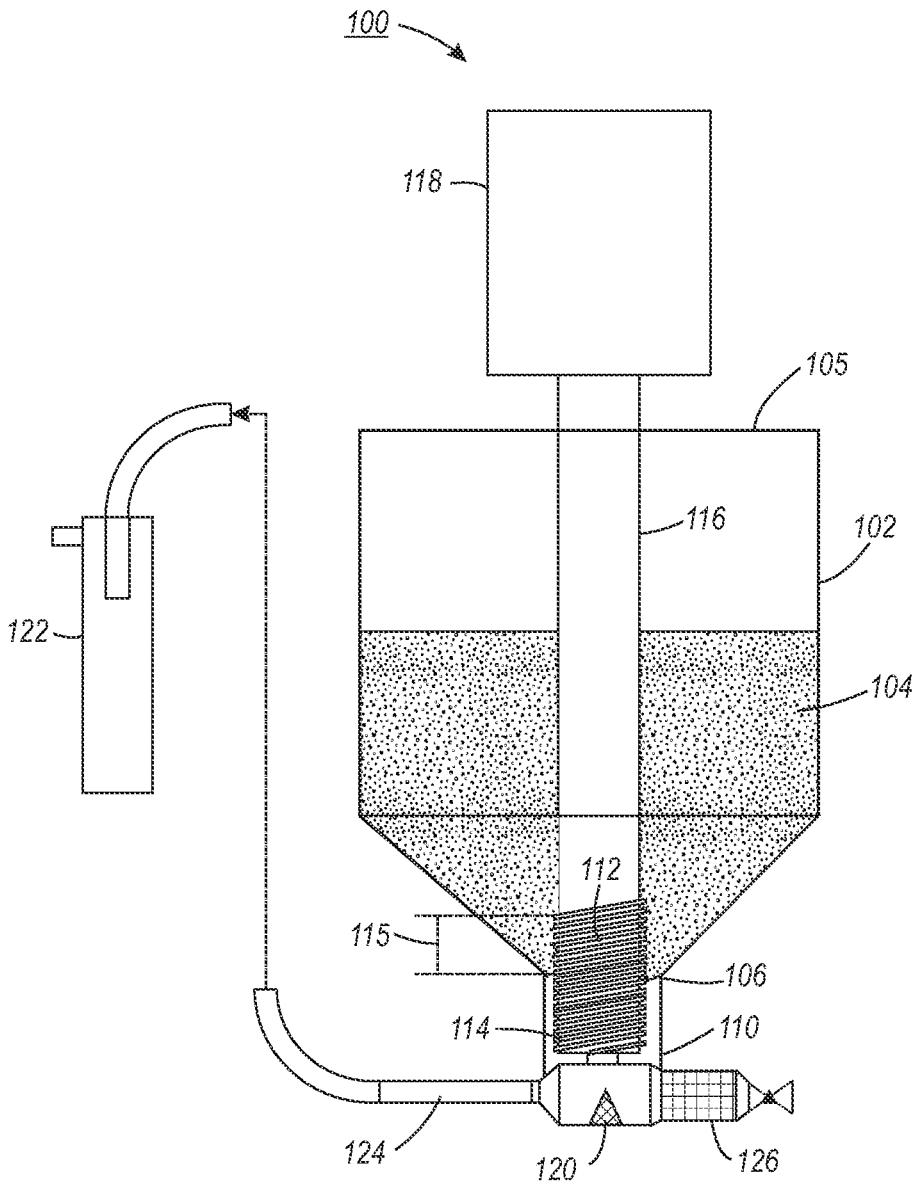
FIG. 1 illustrates an exemplary solid-ink pellet delivery system for supplying solid-ink pellets to an image-forming device from a container.

FIG. 1 illustrates an exemplary solid-ink pellet delivery system 100 for supplying ink pellets to an image-forming device (not shown) from a container 102. For purposes of description, the present disclosure is described in connection with solid-ink pellets delivered from the container 102 to the image-forming device. Those skilled in the art, however, will appreciate that other environments may similarly require delivery of solid-ink pellets for printing or other purposes, from a storage container or similar device. The technology set out here can also be employed to promote flowability of solid particulates and pellets in a variety of other environments. The container 102 is adapted to receive and store solid-ink pellets 104 or pellet-like objects, and this device can be a container, a box, a drum, or any other structure for storing. Any rigid material, such as wood, plastic, or metal, may be employed for forming the container 102.

The container 102 receives the solid-ink pellets 104 from a top portion 105. The bottom portion 106 of the container 102 is conical for allowing gravity flow to guide the pellets 104 towards an extraction point of the container 102.

The solid-ink pellets 104 may be liquefiable wax-based pellets. Typically, an image-forming device melts the pellets 104 before passing them to ink jets for printing. In an embodiment of the present disclosure, the diameter of the solid-ink pellet 104 may be about 0.43 mm-1.3 mm. In general, the size of the solid-ink pellets may range up to a maximum size of about 3 mm. The solid-ink pellets 104, stored in the container 102 over time or during transportation, may conglomerate, forming bridges, or agglomerates, obstructing the extraction path of the solid-ink pellets 104.

The bridges and agglomerates must be broken up to facilitate extraction of the pellets 104 and maintain the flowability of the pellets 104. This separation of agglomerates and extraction of the pellets 104 is facilitated by an extraction assembly 108 having a tubular housing 110 and an auger member 112. The tubular housing 110 is attached to the bottom portion 106 of the container 102 and extends out of the container 102. The auger member 112 is rotatably placed within the tubular housing 110 and includes multiple helical blades 114, with a portion 115 extending out of the tubular housing 110 inside the container 102. In the present embodiment, the blades 114 are at an angle of about 5 degrees. Using gravity flow, the tubular housing 110 receives the solid-ink pellets 104 from the container 102. The rotation of the extended portion 115 of the blades 114 impels the solid-ink pellets 104 downward towards the extraction point. The downward auguring agitates the surrounding solid-ink pellets 104 to separate the coagulated or bridged pellets and maintain the pellet flow.

In an embodiment of the present disclosure, the gap between the tubular housing 110 and the auger member 112 is approximately 0.010 in. Such a gap prevents the auger member 112 from engaging with the sides of the tubular housing 110 and enables proper rotation of the auger member 112 within the tubular housing 110. Also, the gap prevents the unrestricted flow of the pellets 104 through the tubular housing 110 and at the same time prevents the ink from being crushed. This arrangement also ensures that the pellets 104 are agitated by the extended portion 115 of the blades 114 of the auger member 112 before being fed to the image-forming device.

As shown in FIG. 1, the auger member 112 may also include an actuator arm 116 attached to the blades 114. The actuator arm 116 is a solid cylinder extending out of the tubular housing 110 in a vertical position. The bottom end of the cylinder is connected to the blades 114 and the top end is connected to a motor 118. Alternatively, the actuator arm 116 may be an elongated wire or a similar structure. The motor 118 rotates the actuator arm 116, which in turn rotates the blades 114 such that the agglomerates are separated properly by the extended portion 115 of the blades 114. It should be apparent that though the actuator arm 116 is shown being connected to the blades 114, it may be a part of the container 102 and detachably connected to the blades 114. Also, the motor 118 may be directly connected to the blades 114 for rotation. The process of rotating a structure, such as the actuator arm 116 and the blades 114, using a driving apparatus, such as the motor 118 is known to those skilled in the art and is not explained in detail.

Further, a controller (not shown) may be used to initiate the operation of the motor 118. The controller may be actuated manually or may be programmed to activate the motor 118 automatically. Initiation may be timed to occur at convenient intervals, such as before starting the imaging process, once a day, or as preferred. Also the auger member 112 is activated whenever the solid-ink pellets 104 are extracted. Further, rotation speed of the auger member 112 may also be determined by the motor 118. For example, buttons, configured on the motor 118, may be used to select a minimum speed of rotation, a maximum speed, or any other predefined speed.

The bottom end of the tubular housing 110 is connected to a distribution module 120 that receives the agitated solid ink pellets 104. Specifically, the distribution module 120 is hollow cylindrical member receiving the agitated ink pellets 104 from the tubular housing 110. The member is in horizontal position and at a right angle to the tubular housing 110 and the auger member 112. This orientation enables the distribution module 120 to collect the agitated ink pellets 104 and direct them to the image-forming device. Also, the member is open at both the ends. A first open end is connected to a vacuum source 122 through a vacuum tube 124 and a second open end is connected to a filter 126. It would be evident to those skilled in the art that the distribution module 120 may be of any other suitable configuration than that depicted in FIG. 1. For example, instead of cylinder, the distribution module 120 may be rectangular in shape.

To extract the solid ink pellets 104 from the distribution module 120, the vacuum source 122 generates a suction force, and delivers the solid-ink pellets 104 to an image-forming device for printing purposes. In an embodiment of the present disclosure, the vacuum source 122 may be a venturi system known to those skilled in the art. Further, the filter 126, connected opposite to the vacuum source 122, provides a calibrated amount of filtered air adjusted by an inlet valve. The combination of the suction force and the filtered air pull the solid-ink pellets 104 collected in the distribution module 120. The filter 126 used in the present system 100 may be a High Efficiency Particulate Air (HEPA) filter. The application of a venturi and a HEPA filter are well known to those skilled in the art and will not be described in detail here. Alternatively, the distribution module 120 may be connected to any other type of known vacuum source and filter to pull out stored solid-ink pellets 104 or pellet-like objects.

As discussed, the system 100 provides a cost effective and an efficient means to maintain the flowability of solid-ink pellets to an image-forming device, avoiding of feeding failures. The flow rate of the pellets primarily depends on the amount of suction force; however, dimensions of the auger member 112 may also affect the flow rate. The various dimensions of the auger member 112 are illustrated in conjunction with FIGS. 2A and 2B.

FIGS. 2A and 2B show different views of the auger member 112 of the present disclosure. FIG. 2A is a top view of a blade from the helical blades 114, which forms part of the auger member 112. The diameter of the blade is approximately 2.0 in. This diameter enables the blades 114 to properly agitate the solid-ink pellets 104 and break-up obstructions to the pellet flow.

FIG. 2B is a side view of the auger member 112 illustrating the blades 114. In one embodiment, the distance between the blades 114 is approximately 10 times the maximum diameter of the solid-ink pellets 104. Also, the length of the auger member 112 is approximately 6.15 in. It will be evident to a person skilled in the art that the auger member 112 may be constructed having other dimensions than those depicted in FIGS. 2A and 2B, without departing from the scope of the present disclosure.

Figure 3:
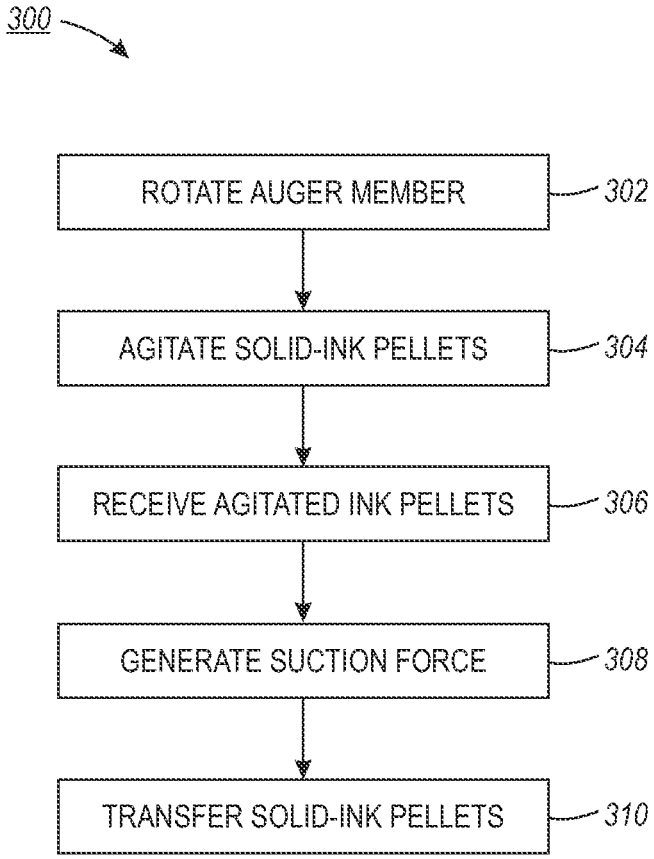
FIG. 3 is a flowchart of an exemplary method for supplying solid-ink pellets to an image-forming device from a container.

FIG. 3 is a flowchart of an exemplary method 300 for delivering solid-ink pellets 104 to an image-forming device from a container, such as the container 102. As shown in FIG. 1, the container 102 includes an auger member 112 placed within the tubular housing 110.

At step 302, the motor 118 rotates the auger member 112. In one embodiment, the motor 118 rotates the auger member 112 on receiving a 'call for pellet' command from the image-forming device, which instructs the container 102 to deliver an uninterrupted flow of the solid-ink pellets 104 for imaging purposes.

The movement of the extended portion 115 of the blades 114 agitates the solid-ink pellets 104 within the container 102, at step 304. These disturbances break up bridges, clumps, agglomerates, or any other obstructions formed within the container 102. At step 306, the distribution module 120 receives the solid-ink pellets agitated by the auger member 112.

At step 308, the vacuum source 122 generates a suction force to extract the solid-ink pellets 104 from the container 102, through the distribution module 120. Finally, at step 310, the extracted solid-ink pellets are delivered to an image-forming device. The container 102 may be refilled with solid-ink pellets through known supplying means. In an embodiment of the present disclosure, bottles of ink may be poured from the top of the container 102.

It should be noted that the description below does not set out specific details of manufacture or design of the various components. Those of skill in the art are familiar with such details, and unless departures from those techniques are set out, techniques, designs and materials known in the art should be employed. Those in the art are capable of choosing suitable manufacturing and design details.

The terminology used herein is for the purpose of describing particular embodiments only and is not intended to be limiting of the disclosure. It will be appreciated that several of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for maintaining flowability of solid-ink pellets in a system for delivering the pellets to an image-forming device, the apparatus comprising:

a container for storing the solid-ink pellets; and an extraction assembly for extracting the solid-ink pellets from the container, the extraction assembly comprising:

a tubular housing extending from the bottom portion of the container to receive the solid-ink pellets from the container; and an auger member rotatably disposed within the tubular housing a distribution module connected to the bottom end of the tubular housing for receiving the ink pellets;

a vacuum source for introducing airflow within the distribution module to withdraw the ink pellets; and a filter, opposite to the vacuum source, to provide a calibrated amount of filtered make-up air to transport the ink pellets to the image-forming device.

2. The apparatus of claim 1, wherein the auger member pulls the solid-ink pellets downward.

3. The apparatus of claim 1 further comprising a motor operatively coupled to the auger member for rotating the auger member at a particular speed.

4. The apparatus of claim 1, wherein the auger member includes a plurality of helical blades at an angle of about 5 degrees.

5. The apparatus of claim 4, wherein the distance between each helical blade is approximately 10 times the maximum diameter of the solid-ink pellets.

6. The apparatus of claim 1, wherein the auger member further comprises:

a plurality of helical blades such that a portion of the blades extends out of the tubular housing;

an actuator arm attached to the blades; and a motor operatively coupled to the actuator arm for rotating the actuator arm;

wherein the rotation of the actuator arm rotates the extended portion of the blades, thereby breaking up the obstructions to the pellet flow.

7. The apparatus of claim 1, wherein the gap between the tubular housing and the auger member is approximately 0.010 inches for enabling proper rotation of the auger member.

8. A system for delivering solid-ink pellets to an image-forming device comprising:

a container for storing the solid-ink pellets;

an extraction assembly for extracting the solid-ink pellets from the container, wherein the extraction assembly comprises:

a tubular housing extending from the bottom portion of the container to receive the solid-ink pellets; and an auger member rotatably disposed within the tubular housing, the auger member comprising:

a plurality of helical blades such that a portion of the blades extends out of the tubular housing; and an actuator arm attached to the blades for rotating the blades;

a distribution module connected to the bottom end of the tubular housing for receiving the ink pellets;

a vacuum source for introducing airflow within the distribution module to withdraw the ink pellets; and a filter, opposite to the vacuum source, to provide a calibrated amount of filtered make-up air to transport the ink pellets to the image-forming device.

9. The apparatus of claim 8, wherein the auger member pulls the solid-ink pellets downward.

10. The system of claim 8, wherein the bottom portion of the container is conical in shape.

11. The system of claim 8, wherein the auger member further comprises a motor operatively coupled to the actuator arm for rotating the actuator arm at a particular speed.

12. A system for delivering solid-ink pellets to an image-forming device, maintaining flowability of the pellets, the system comprising:

a container for storing solid-ink pellets, wherein storage of the solid-ink pellets in the container forms bridges or clumps, obstructing the extraction of the solid-ink pellets from the container;

an extraction assembly for extracting the solid-ink pellets from the container, the extraction assembly comprising:

a tubular housing extending from the bottom portion of the container to receive the solid-ink pellets; and an auger member rotatably disposed within the tubular housing for agitating the solid-ink pellets within the housing to break up obstructions to pellet flow; and a distribution module, connected to the bottom end of the tubular housing, for receiving the agitated solid-ink pellets;

a vacuum source for introducing airflow within the distribution module to withdraw the ink pellets; and a filter, opposite to the vacuum source, to provide a calibrated amount of filtered make-up air to transport the ink pellets to the image-forming device.

13. The system of claim 12, wherein the auger member pulls the solid-ink pellets downward.

14. The system of claim 12, wherein the auger member further comprises:

a plurality of helical blades such that a portion of the blades extends out of the tubular housing;

an actuator arm attached to the blades; and a motor operatively coupled to the actuator arm for rotating the actuator arm;

wherein the rotation of the actuator arm rotates the extended portion of the blades of the auger member, thereby breaking up the obstructions to the pellet flow.

15. A method for maintaining flowability of solid-ink pellets, stored in a container, to an image-forming device, the method comprising:

providing a tubular housing extending from the container;

providing an auger member disposed within the tubular assembly, wherein the auger member includes a plurality of helical blades at an angle of about 5 degrees such that a portion of the blades extends out of the tubular housing;

rotating the auger member at a particular speed;

agitating the solid-ink pellets through the movement of the extended portion of the blades of the auger member;

receiving the agitated ink pellets in a distribution module connected to the bottom end of the tubular housing;

generating a suction force to extract the solid-ink pellets through the distribution module; and transferring the extracted solid-ink pellets to the image-forming device.

16. The method of claim 15, wherein the auger member pulls the solid-ink pellets downward.

17. The method of claim 15, wherein the agitating step includes breaking up bridges and clumps formed in the solid-ink pellets, maintaining flowability of the solid-ink pellets.

18. An apparatus for maintaining flowability of solid-ink pellets in a system for delivering the pellets to an image-forming device, the apparatus comprising:

a tubular housing to receive the solid-ink pellets;

a plurality of helical blades disposed within the tubular housing such that a portion of the blades extends out of the tubular housing; and an actuator arm attached to the blades;

a distribution module connected to the bottom end of the tubular housing for receiving the ink pellets;

a vacuum source for introducing airflow within the distribution module to withdraw the ink pellets; and a filter, opposite to the vacuum source, to provide a calibrated amount of filtered make-up air to transport the ink pellets to the image-forming device;

wherein rotation of the actuator arm rotates the extended portion of the blades, thereby agitating the solid-ink pellets.

19. The apparatus of claim 18, wherein the auger member pulls the solid-ink pellets downward.

* * * * *